US009759172B2

(12) United States Patent
Wolff et al.

(10) Patent No.: US 9,759,172 B2
(45) Date of Patent: Sep. 12, 2017

(54) FUEL INJECTOR HAVING A REDUCED NUMBER OF COMPONENTS

(75) Inventors: Guenter Wolff, Schwieberdingen (DE); Martin Scheffel, Vaihingen (DE); Sebastian Wieschollek, Schwieberdingen (DE); Axel Bormann, Bamberg (DE); Johann Bayer, Strullendorf (DE)

(73) Assignee: Robert Bosch GmbH, Stuttgart (DE)

( * ) Notice: Subject to any disclaimer, the term of this patent is extended or adjusted under 35 U.S.C. 154(b) by 354 days.

(21) Appl. No.: 13/809,133

(22) PCT Filed: May 13, 2011

(86) PCT No.: PCT/EP2011/057780

§ 371 (c)(1),
(2), (4) Date: Mar. 25, 2013

(87) PCT Pub. No.: WO2012/007201

PCT Pub. Date: Jan. 19, 2012

(65) Prior Publication Data

US 2013/0186986 A1 Jul. 25, 2013

(30) Foreign Application Priority Data

Jul. 13, 2010 (DE) ..... 10 2010 031 277

(51) Int. Cl.
*F02M 51/00* (2006.01)
*F02M 61/16* (2006.01)

(52) U.S. Cl.
CPC ..... *F02M 51/005* (2013.01); *F02M 61/168* (2013.01); *F02M 2200/8015* (2013.01);
(Continued)

(58) Field of Classification Search
CPC ..... F02M 51/005; F02M 51/061; F02M 51/0614; F02M 69/145; F02M 61/168;
(Continued)

(56) References Cited

U.S. PATENT DOCUMENTS 6,152,387 A * 11/2000 Ricco ..... 239/585.1
6,910,642 B2 6/2005 Maier
2004/0188552 A1 9/2004 Saito et al.

FOREIGN PATENT DOCUMENTS

EP 1 795 740 6/2007
EP 2 103 803 9/2009
(Continued)

OTHER PUBLICATIONS

International Search Report, PCT International Application No. PCT/EP2011/057780, dated Aug. 5, 2011.

*Primary Examiner* — Christopher Kim
(74) *Attorney, Agent, or Firm* — Norton Rose Fulbright US LLP; Gerard Messina

(57) ABSTRACT

A fuel injector which includes an actuator having an electrical contact element, a plug, a fuel supply pipe, and an injection-molded housing part. The plug has a base body, an electrical connection element for an electrical connection with the electrical contact element of the actuator, and a rib which projects from the base body, the injection-molded housing part surrounding the electrical connection element of the plug and being injection-molded on the rib of the plug and the fuel supply pipe.

12 Claims, 5 Drawing Sheets

(52) U.S. Cl.
CPC ..... *F02M 2200/8023* (2013.01); *F02M 2200/8046* (2013.01); *F02M 2200/9015* (2013.01)

(58) Field of Classification Search
CPC ... F02M 2200/8046; F02M 2200/9015; F02M 2200/8015; F02M 2200/8023
USPC ..... 239/585.1–586
See application file for complete search history.

(56) References Cited

FOREIGN PATENT DOCUMENTS

| | | |
|---|---|---|
| JP | 2004-518849 | 6/2004 |
| JP | 2008-522094 | 6/2008 |
| WO | WO 02/066818 | 8/2002 |

* cited by examiner

FUEL INJECTOR HAVING A REDUCED NUMBER OF COMPONENTS

FIELD

The present invention relates to an improved fuel injector, which has a lower number of components and a slimmer design layout.

BACKGROUND INFORMATION

One problem in conventional fuel injectors is the plugs for the electrical connection of the valve and a housing surrounding the valve. The fuel injectors are normally extrusion-coated following assembly in order to thus produce the housing and possibly the plug. However, in the case of the plug there are high demands on the dimensional accuracy in order to take the required vibration stresses into account and to provide sufficient tightness with regard to spray water etc. An injection mold in the injection-molding process should be as short as possible, and an injection pressure as high as possible. Generally, only a narrow annular space must be injection-molded in the region of an actuator of the fuel injector; in this case as well, a short fill time and high injection pressure are advantageous. However, excessive injection pressure can damage components of the actuator. New engine concepts furthermore require injection valves to be slimmer overall, as well as longer in the axial direction in order to satisfy the installation requirements. However, problems may arise when housings for such valves are injection-molded, because long stretches from one injection point to an end of the injection mold result in the process. In this context, the fuel injectors should also have a simple design and be manufacturable in the most cost-effective manner possible.

SUMMARY

An example fuel injector according to the present invention may have the advantage that an injection-molded housing component is able to be injection-molded rapidly and at a pressure that is not excessive. Furthermore, a slim and elongated fuel injector is able to be provided in the present invention, and the number of components is reduced. In addition, a plug for an electrical connection of the fuel injector has very high dimensional accuracy. According to an example embodiment of the present invention, this is accomplished in that the fuel injector includes an actuator which includes electrical contact elements, a plug, a fuel supply pipe and an injection-molded housing part. The plug has a base body, an electrical connection element such as a current bar, for example, for an electrical connection with the electrical contact elements of the actuator, and a rib which projects from the base body. The injection-molded housing part surrounds the electrical connection element of the plug and is injected-molded onto the rib of the plug and the fuel supply pipe. The rib of the plug is at least partially, but preferably completely, surrounded by the housing part. This makes it possible for the plug to be produced in a first step together with the electrical connection element, as subassembly, so that the plug is able to have relatively small and compact dimensions for an injection-molding process and thus is manufacturable with high precision. The electrical connection element projects from the plug and, after assembly, is connected to the remaining components of the fuel injector by injection-molding the housing part. In this way the injection-molded housing part, too, is able to be optimally configured with regard to the required specifications, and an injection-molding process of the housing part may be less complex. The actuator of the fuel injector preferably is a solenoid actuator having a coil, on which the electrical contact elements such as contact pins or contact fins are situated. It should be noted that a plug in the present invention may refer both to a projecting plug element and a plug receptacle.

Preferably, the electrical connection element of the plug contacts the contact elements of the actuator directly. This makes it possible to dispense with additional intermediate contact elements, so that the assembly and also an injection-molding process for the housing part are simplified.

It is furthermore preferred if a region of the electrical connection element routed out of the housing is at least four times as long as a region of the electrical connection element situated in the plug itself. In this simple manner it is possible to provide fuel injectors which have a slim, elongated design.

Furthermore, the electrical connection element of the plug preferably includes at least one support element, which supports the electrical connection element on the fuel supply pipe. The support element preferably is a clip. Depending on the length of the electrical connection element, it is also possible to provide multiple support elements.

In order to achieve a reliable connection of the plug to the injection-molded housing part and to provide a splash-proof connection between plug and housing part, a labyrinth is preferably provided between the plug and the injection-molded housing part. For this purpose multiple projecting elements are provided on the plug, which are enclosed by the injection-molded housing in the finished state.

According to one further preferred development of the present invention, the rib of the plug may have at least one first formed element, which is surrounded by the injection-molded housing part, in order to achieve interlocking between the rib and the injection-molded housing part. This results in a secure connection between the plug and the injection-molded housing part. The first formed element preferably is a projecting element or a recess, or an element having an undercut. The shape of the projecting element or the recess is freely selectable. Preferably, the projecting element is implemented in the form of a hemisphere or an oval or trapezoid, or developed with other inclined surfaces, or it has a design that projects convexly or concavely. The projecting element may be provided on only one side of the rib or, alternatively, also on both sides of the rib. A recess on the one side may be provided as blind hole or be developed as through hole. The shape of the recess is likewise freely selectable; in particular, it may have a trapezoidal or concave shape or be implemented as cylindrical bore, as elongated hole, etc. It should be noted that a random number of projecting elements and/or recesses and random combinations is possible.

According to one further preferred development of the present invention, the rib of the plug includes a second formed element, which is not surrounded by the injection-molded housing part. In other words, the second formed element lies freely exposed on the rib and thus is not part of the injection molding of the housing part. The second formed element allows the plug to be positioned in an injection-molding tool for producing the injection-molded housing part and thus is in contact with the injection-molding tool during the injection-molding process. As a result, the second formed element is not injection-molded and lies freely exposed in the finished fuel injector. The second formed element enables secure and uncomplicated positioning of the previously manufactured subassembly, which includes the plug and the electrical connection element.

In accordance with the present invention, a separate production of the plug and housing part by an injection-molding process is allowed; especially the plug with the electrical connection part is able to be produced very inexpensively according to the required specifications for the plug in a first step. The direct linkage of the electrical connection element of the plug to the contact elements of the actuator also requires fewer components. In an especially preferred manner, the example fuel injector according to the present invention is used for fuel injection.

BRIEF DESCRIPTION OF THE DRAWINGS

Exemplary embodiments of the present invention are described in detail below, with reference to the figures.

DETAILED DESCRIPTION OF EXAMPLE EMBODIMENTS

Below, a fuel injector 1 according to a first preferred exemplary embodiment of the present invention is described in detail with reference to FIGS. 1 through 6.

Figure 1:
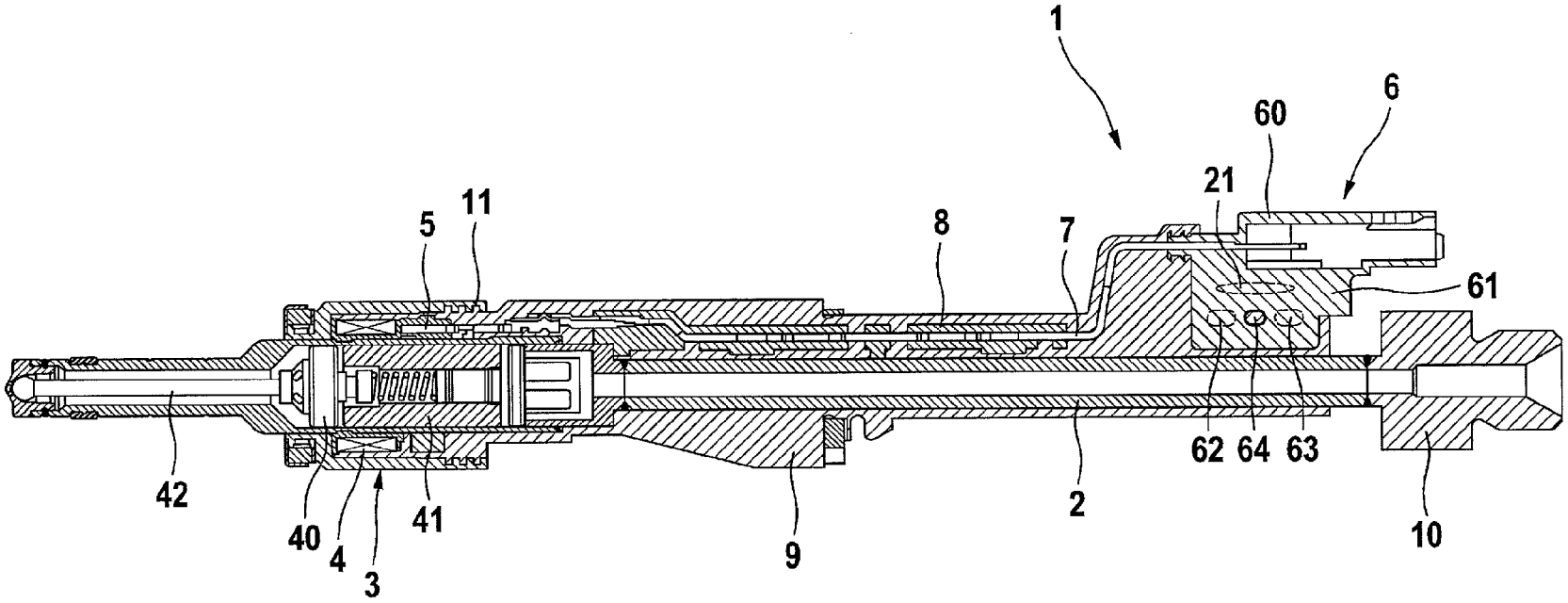
FIG. 1 shows a schematic sectional view of a fuel injector according to a first exemplary embodiment of the present invention.

As can be inferred from FIG. 1, in particular, fuel injector 1 of the first exemplary embodiment includes a fuel supply pipe 2 on which a connection piece 10 is disposed for the supply of fuel. Furthermore, fuel injector 1 has a solenoid actuator 3 provided with a coil 4, an armature 40 and a pole body 41. Armature 40 is connected to a needle 42, which releases spray-discharge openings when solenoid actuator 3 is activated, in order to inject fuel. Furthermore, a contact element 5 for an electrical contact is disposed on coil 4. The fuel injector is an inwardly opening valve.

Figure 5:
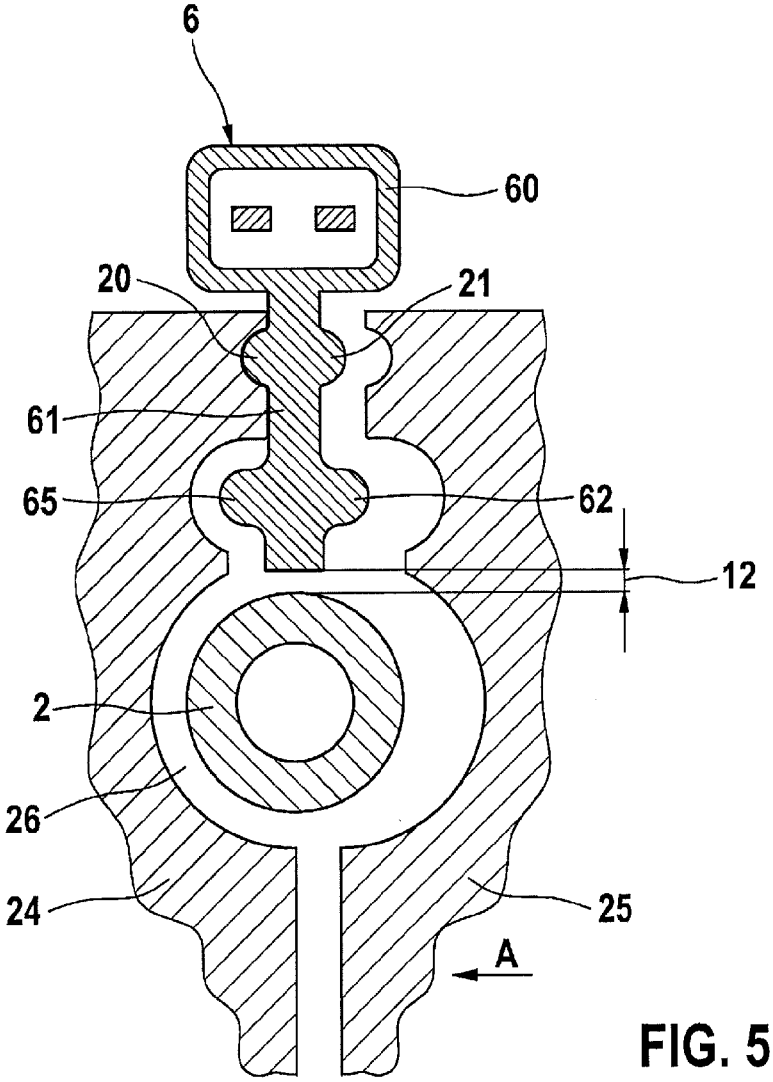
FIG. 5 shows a schematic sectional view, which shows a manufacturing process of the fuel injector of the first exemplary embodiment.
Figure 6:
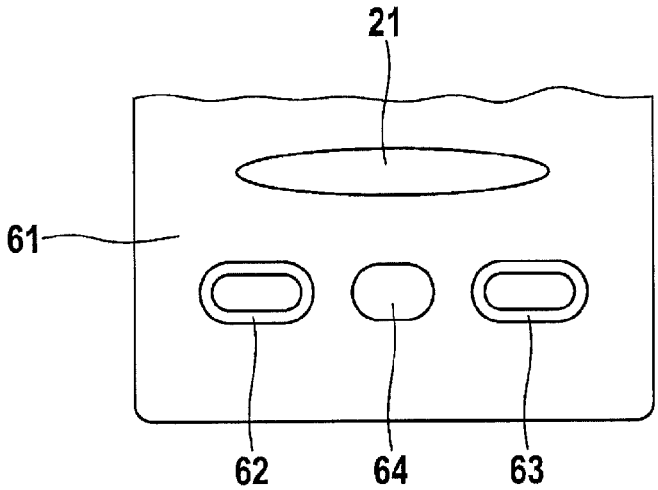
FIG. 6 shows a schematic side view of a rib of a plug from the first exemplary embodiment.

Fuel injector 1 also includes a plug 6, via which electrical contacting takes place on the vehicle side. Plug 6 is shown in detail in FIGS. 2 and 6. Plug 6 includes a base body 60 provided with a rib 61 which projects therefrom. Rib 61 projects on an underside of base body 60 and has a flat, essentially rectangular shape. As can be gathered from FIGS. 5 and 6, in particular, first formed elements are provided on rib 61 in the shape of projecting elements 62, 63, 65, and in the form of a recess, 64, which is a continuous recess. In addition, second formed elements 20, 21 (see FIG. 5) are provided on rib 61, which help in positioning plug 6 in an injection-molding tool for producing an injection-molded housing part 9. FIG. 5 shows two parts 24, 25 of an injection-molding die with an inserted plug and inserted fuel supply pipe 2. In the finished state of the fuel injector second formed elements 20, 21 are not surrounded by the injection-molded housing part 9 and thus are freely exposed.

Figure 2:
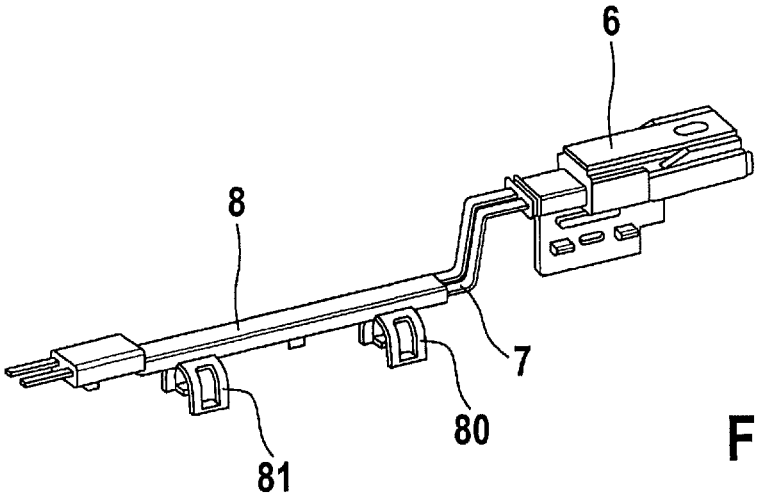
FIG. 2 shows a perspective view of a plug of the first exemplary embodiment.
Figure 3:
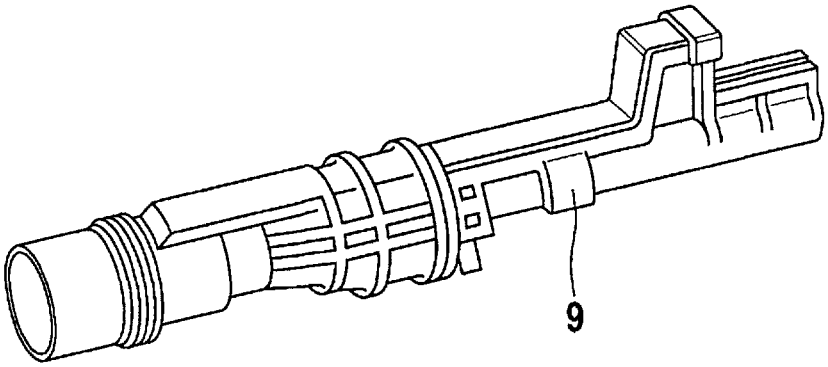
FIG. 3 shows a perspective view of an injection-molded housing part.

As can be gathered from FIG. 2, in particular, plug 6 has a support element 8 in addition to elongated electrical connection element 7 developed in the form of two current bars. Support element 8 is used for positioning plug 6 on fuel supply pipe 2, and two clips 80, 81 are provided on support element 8. With the aid of clips 80, 81, plug 6 is easily clipped onto fuel supply pipe 2 and thus is securely fixed in place for a subsequent injection-molding process.

Figure 4:
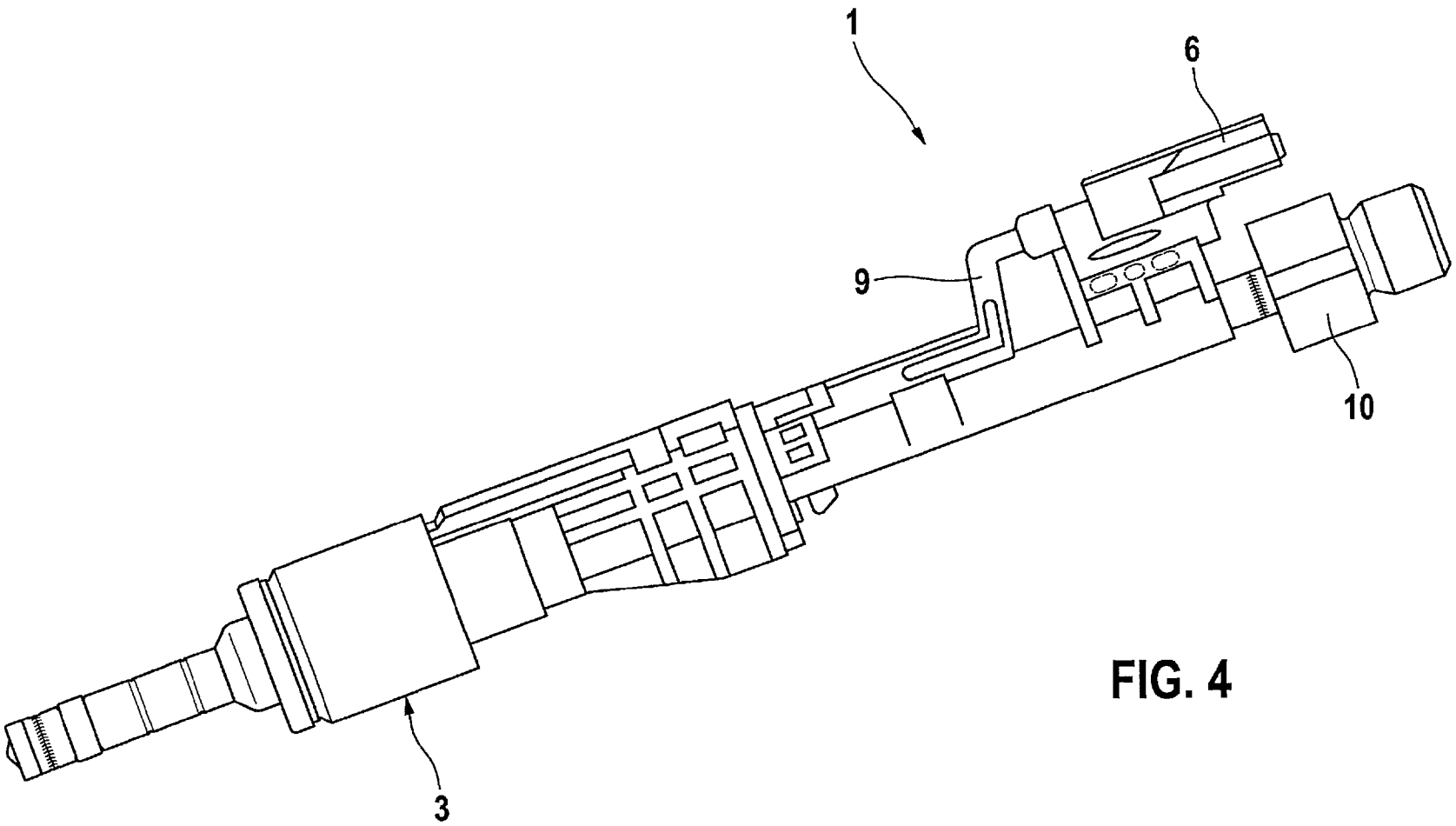
FIG. 4 shows a side view of the fuel injector from FIG. 1.

As can be gathered from FIG. 4, in particular, injection-molded housing part 9 does not surround all components of the fuel injector. Especially rib 61 of plug 6 is only partially enclosed. Nevertheless, housing part 9 surrounds rib 61 in such a way that a stable and secure connection is ensured between plug 6 and the other components of the fuel injector.

As described above, plug 6 is first provided as prepared subassembly for the production of fuel injector 1. For this purpose base body 60 and rib 61 of plug 6 are already able to be injection-molded on electrical connection element 7 in a first injection-molding step. In so doing, the parameters for the injection-molding process required for the plug-in connection are precisely adjustable, so that a plug having high dimensional accuracy is obtained. At the same time or in a subsequent step, support element 8 may be injection-molded as well. In a further step, the fuel injector is then preassembled, and the plug-subassembly is clipped onto fuel supply pipe 2 with the aid of clips 80, 81. Then, first and second injection-molding die 24, 25 are placed around the preassembled fuel injector, which can be seen in FIG. 5. Arrow A indicates that injection-molding die 25 must still be moved in the direction of the arrow, toward other injection-molding die 24, in order to obtain the final injection-molding state. This produces a cavity 26 between injection-molding dies 24, 25 and the preassembled components of the fuel injector. As can be gathered from FIG. 5, a gap 12 exists between rib 61 and fuel supply pipe 2, which is filled after housing part 9 has been injection-molded. The plug is precisely positioned at corresponding recesses of the injection-molding dies using second formed elements 20, 21. In the next step the injection-molding of housing part 9 may take place. In the process, the parameters required for housing part 9 in connection with the injection-molding operation are adjustable, especially in the region of the solenoid actuator. Since electrical connection elements 7 are very long, direct contact to contact elements 5 of coil 4 is able to be established.

Over all, fuel injector 1 according to the present invention thus has a slim and elongated design, without such a design requiring an excessive number of components.

Figure 7:
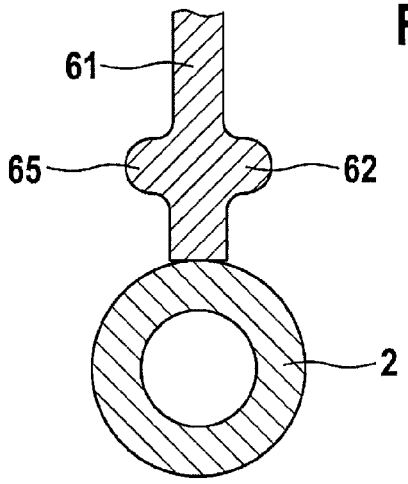
FIGS. 7 through 9 shows alternative developments of the fuel injector according to the present invention.
Figure 8:
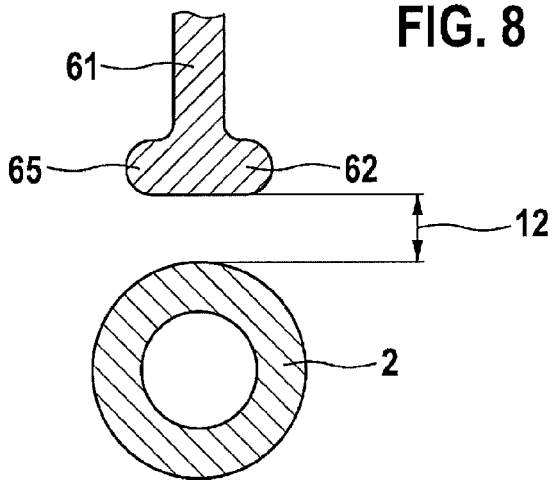
Figure 9:
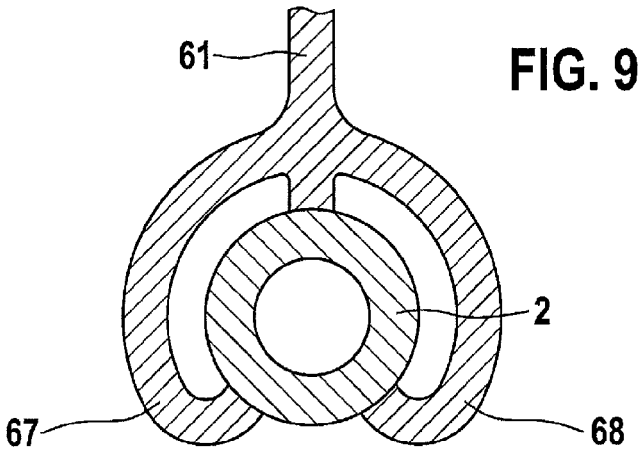

FIGS. 7 through 9 show preferred alternatives of fuel injector 1; identical or functionally equivalent parts have been provided with the same reference numerals as in the first exemplary embodiment. As can be gathered from FIG. 7, there is direct contact between rib 61 and the outer circumference of fuel supply pipe 2 in this preferred exemplary embodiment. In the exemplary embodiment shown in FIG. 8, another gap 12 is provided, but rib 61 has a different design. In this exemplary embodiment, the two projecting elements 62, 65 are disposed at both sides of rib 61, at the free end of rib 61. FIG. 9 shows a preferred exemplary embodiment in which two holding regions 67, 68 are situated at rib 61, which partially surround fuel supply pipe 2.

Holding elements 67, 68 are flexible, so that the rib is able to be slipped onto fuel supply pipe 2. Once again, rib 61 is resting on fuel supply pipe 2.

With regard to all of the described exemplary embodiments, it should be noted that the first formed elements are able to be placed on one side of rib 61 only and also on both sides of rib 61. If the first formed elements are recesses, they may be developed as a type of blind hole or as continuous recesses. As far as second formed elements 20, 24 are concerned, they are preferably provided on both sides of rib 61. However, it is also possible to place a formed element on only one side of the rib. It is furthermore noted that it may also be the case that multiple formed elements are situated on one side or on both sides of rib 61.

In addition, it is pointed out that a symmetrical or asymmetrical placement of the formed elements on both sides of rib 61 may be implemented.

As a result, the present invention makes it possible to produce a fuel injector 1 of a higher quality, which fuel injector 1 has a narrow and slim design, in particular. In addition, less damage of components occurs during the injection-molding of housing part 9, resulting in fewer rejected parts.

What is claimed is:

1. A fuel injector, comprising:

an actuator having an electrical contact element;

a plug having a base body, an electrical connection element for an electrical connection with the electrical contact element of the actuator, and a rib which projects from the base body;

a fuel supply pipe; and an injection-molded housing part which surrounds the electrical connection element of the plug and is injection-molded onto the rib of the plug and the fuel supply pipe, wherein the rib of the plug has at least one first formed element which is enclosed by the injection-molded housing part to obtain a secure connection between the rib and the injection-molded housing part, and wherein the first formed element includes a recess, and wherein the recess is at least one of a blind hole and a through hole.

2. The fuel injector as recited in claim 1, wherein the electrical connection element of the plug directly contacts the contact elements of the actuator.

3. The fuel injector as recited in claim 1, wherein a region of the electrical connection element is routed out of the base body of the plug and is at least four times as long as a region of the electrical connection element situated inside the base body.

4. The fuel injector as recited in claim 1, wherein the electrical connection element includes a support element which supports the electrical connection element on the fuel supply pipe.

5. The fuel injector as recited in claim 4, wherein the support element includes at least one clip.

6. The fuel injector as recited in claim 1, wherein a labyrinth is between the plug and the injection-molded housing part.

7. The fuel injector as recited in claim 1, wherein the rib of the plug includes a second formed element which is exposed on the rib to allow the plug to be positioned in an injection-mold tool for producing the injection-molded housing part.

8. The fuel injector as recited in claim 1, wherein the injection-molded housing part fully surrounds the rib.

9. The fuel injector as recited in claim 1, wherein the first formed element includes the a projecting element.

10. The fuel injector as recited in claim 1, wherein the first formed element includes at least one of the recess a projecting element and an element having an undercut.

11. The fuel injector as recited in claim 1, wherein the first formed element includes the an element having the an undercut.

12. A fuel injector, comprising:

an actuator having an electrical contact element;

a plug having a base body, an electrical connection element for an electrical connection with the electrical contact element of the actuator, and a rib which projects from the base body;

a fuel supply pipe; and an injection-molded housing part which surrounds the electrical connection element of the plug and is injection-molded onto the rib of the plug and the fuel supply pipe, wherein the rib of the plug extends in a radial direction of the fuel supply pipe and has at least one first formed element which is enclosed by the injection-molded housing part to obtain a secure connection between the rib and the injection-molded housing part, wherein the first formed element includes at least one straight projecting element, wherein the at least one straight projecting element projects laterally from the rib, wherein the fuel supply pipe extends in a longitudinal direction, the longitudinal direction being orthogonal to the radial direction, and wherein the at least one straight projecting element projects in a lateral direction, the lateral direction being orthogonal to the radial direction and the longitudinal direction.

* * * * *